United States Patent [19]

Estes

[11] 3,976,848

[45] Aug. 24, 1976

[54] DISPOSABLE NOISE REDUCING HEARING AID ATTACHMENT

[76] Inventor: Roger Q. Estes, c/o P.H. Shelledy Peyton Bldg., Spokane, Wash. 99201

[22] Filed: Aug. 21, 1975

[21] Appl. No.: 606,513

[52] U.S. Cl. ..... 179/107 R; 179/180; 181/166

[51] Int. Cl.[2] ..... H04R 25/00

[58] Field of Search ..... 179/107 R, 178, 180, 179/185, 1 P; 181/166

[56] References Cited

UNITED STATES PATENTS

| | | | |
|---|---|---|---|
| 2,507,375 | 5/1950 | Hartwell et al. | 179/180 |
| 3,140,363 | 7/1964 | Barrows | 179/107 R |
| 3,603,427 | 9/1971 | Sotome | 181/166 |

*Primary Examiner*—George G. Stellar
*Attorney, Agent, or Firm*—Wells, St. John & Roberts

[57] ABSTRACT

A disposable noise reducing hearing aid attachment is provided for covering the sound inlet of a hearing aid to reduce the amplitude of random noises such as wind noises and to prevent dirt and moisture from entering the sound inlet. The attachment includes a flexible foam pad having an aperture formed therethrough for alignment with the sound inlet. The pad is supported by a backing having a coating of adhesive for removably supporting the attachment to the hearing aid. A wool filter is associated with the pad aperture to reduce the random noise, and dirt and moisture from entering the sound inlet.

6 Claims, 5 Drawing Figures

FIG 1
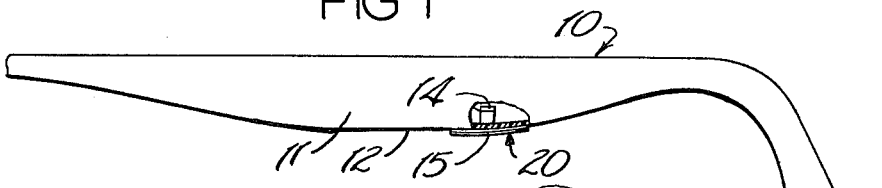
FIG 5
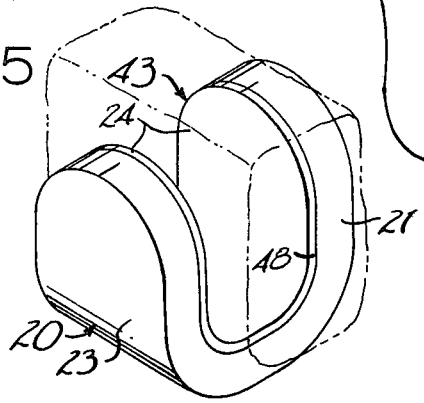
FIG 2
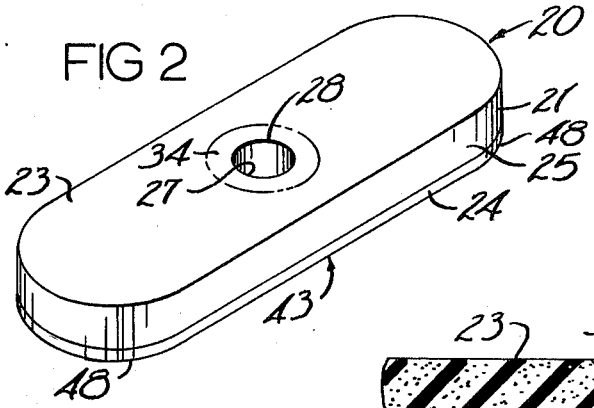
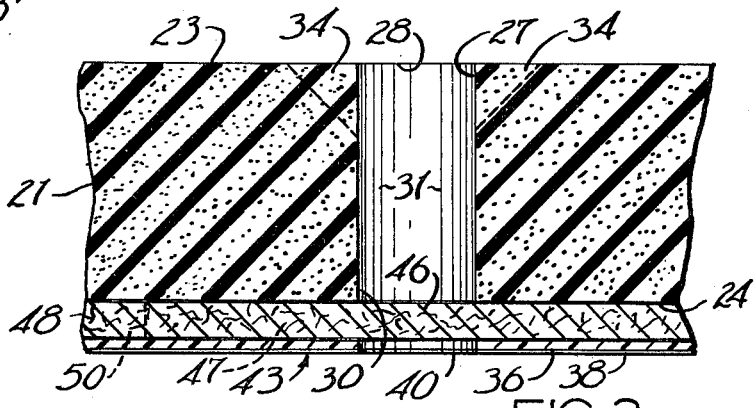
FIG 3
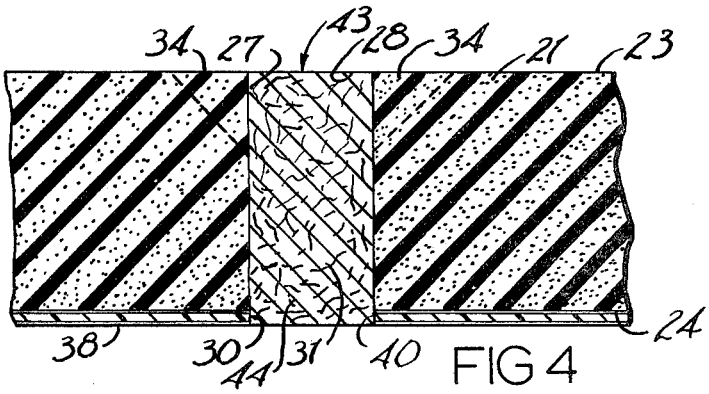
FIG 4

DISPOSABLE NOISE REDUCING HEARING AID ATTACHMENT

BACKGROUND OF THE INVENTION

This invention is related to hearing aids and more particularly to hearing aids provided with the attachments for reducing environmental noise.

Frequently when the hearing aid user is out-of-doors a breeze or wind creates an air velocity across the sound inlet of the hearing aid causing a whistling noise or "Coke-bottle" effect resulting in very annoying random noises to the hearing aid user. Additionally because of perspiration of the user and moisture conditions in the atmosphere, the sound inlet to the microphone of the hearing aid frequently becomes corroded or clogged requiring hearing aid replacement. Additionally, dust and dirst migrate into the sound inlet causing degradation of the sound system.

Consequently, one of the principal objects of this invention is to provide a disposable noise reducing hearing aid attachment that is attachable to the hearing aid over the sound inlet (1) to reduce the amplitude of audible noise, particularly those caused by wind or breezes, (2) to prevent dust and dirt from passing into the sound inlet of the hearing aid and (3) to prevent moisture from passing into the sound inlet of the hearing aid.

A further object of this invention is to provide a disposable hearing aid attachment that is very economical to manufacture and quite efficient in operation to reduce random wind noises from the sound system of hearing aids.

A further object of this invention is to provide a disposable hearing aid attachment for covering the sound inlet of a hearing aid that has a moisture absorbent to absorb moisture and to prevent moisture from entering the sound inlet.

An additional object of this invention is to provide a disposable noise reducing hearing attachment that may be easily attached by the user and disposably removed when replacement is desired.

These and other objects and advantages of this invention will become apparent upon the reading of the following detailed description of a preferred and alternate embodiment.

BRIEF DESCRIPTION OF THE DRAWINGS

A preferred and alternate embodiment of this invention is disclosed in the attached drawing, in which:

FIG. 1 is a fragmentary side view of a portion of a typical hearing aid illustrating a dispoable noise reducing hearing aid attachment covering a sound inlet;

FIG. 2 is a perspective view of the disposable noise reducing hearing aid attachment;

FIG. 3 is a fragmentary cross sectional view of a preferred embodiment of the disposable noise reducing hearing aid attachment;

FIG. 4 is a fragmentary cross sectional view of an alternate embodiment; and

FIG. 5 is a pictorial view of the attachment in a flexed condition.

DETAILED DESCRIPTION OF THE INVENTION

Referring in detail to the drawings, there is illustrated in FIG. 1 a hearing aid generally designated with the numeral 10. The hearing aid 10 may be of various configurations, having a sound inlet 15 exposed to the environment. Generally the hearing aid includes a body 11 that is securable to the user, in which the body includes a housing 10 that has an internal microphone 14. The housing 12 has a sound inlet 15 formed in the housing for transmitting audible sound from the environment to the microphone 14.

This invention is concerned with a disposable noise reducing hearing aid attachment generally designated with the numeral 20 that is removably attchable to the hearing aid overlying the sound inlet 15. The disposable hearing aid attachment 20 is flexible so that it can be adjusted to various housing contours. Additionally the attachment 20 can be made of various shapes and sizes, depending upon the type of hearing aid and the environment in which it is utilized.

As shown in FIG. 2 the attachment 20 includes a flexible pad 21 that has a top surface 23, a bottom surface 24 and a periphery 25. Preferably the pad 21 is constructed of a flexible polyvinyl plastic foam that is quite inert to chemical reaction and moisture. The pad 21 has an aperture 27 formed therethrough from the top surface 23 to the bottom surface 24 forming an entrance opening 28 in the top surface 23 and an exit opening 30 as shown in FIGS. 3 and 4 in the bottom surface 24. When the attachment 20 is secured to the hearing aid, the aperture 27 should be aligned with the sound inlet 15 to transmit audible sound through the aperture 27 into the sound inlet 15. The aperture 27 has a central cavity 31 as shown in FIGS. 3 and 4 between the entrance opening 28 and the exit opening 30. The top surface 23 has a surface region 34 surrounding the entrance opening 28 of a contrasting color to the color of the remainder of the surface 23. The purpose of the contrasting color region is to clearly identify to the user the location of the aperture 27 so that the user can easily align the aperture 27 with the sound inlet 15 when the attachment is secured to the housing 12. Preferably the surface region 34 surrounds the aperture 27 in a coaxial arrangement to clearly illuminate the location of the aperture 27.

With reference to FIGS. 3 and 4 disposable attachment 20 further includes a flexible backing 36 constructed of a sheet material that is coextensive with the dimensions of the pad for operatively supportng the pad and removably securing the attachment to the hearing aid. Preferably the flexible backing is constructed of a thin flexible plastic sheet material having a coating 38 of adhesive for removably securing the attachment to the hearing aid 10. The flexible backing includes an aperture 40 formed therein generally coextensive with the aperture 27.

Additionally the attachment 20 includes a sound, moisture and air filter 43 associated with the aperture 27 for reducing the amplitude of audible noise transmitted through the aperture 27 and for preventing dust and other particles from being transmitted through the aperture 27 into the sound inlet 15. Additionally the filter absorbs moisture that may be present in either the aperture 27 or the sound inlet 14 to prevent the microphobne or internal components of the hearing aid from becoming corroded or rendered ineffective because of excessive moisture. Preferably the filter is constructed at least in part of moisture absorbing fibers of either wool or cotton. Optimumly the filter is constructed of 100% wool.

In the preferred embodiment (FIG. 4), the filter 43 is secured in the cavity 31 extending substantially from the opening 28 to the exit 30. Preferably the filter 43 has a shape (cylindrical) that is complementary to the configuration of the central cavity 31 so that random noise such as the wind noise will be reduced, dust and dirt will be prevented from entering the sound inlet 15 and moisture will be absorbed by the fibers of the wool or cotton.

In an alternate embodiment, the filter 43 is formed as a layer that is coextensive with the dimensions of the pad 22 and is sandwiched between the pad 22 and the flexible backing 36. The filter 43 has a central aperture region 46 superimposed over the aperture 40 with a first surrounding region 47 adjacent the aperture region 46. The filter layer 43 includes a remote region 48 surrounding the region 47 in which the remote region 48 contains a moisture absorbent crystalline material 50. Preferably the crystalline material is sodium chloride. The purpose of the moisture absorbent crystalline material is to draw moisture from the aperture 27 or sound inlet 15 through the surrounding region 47 to the remote region 48. In this manner the attachment 20 contains a significant moisture absorbing capability adding to the life of the attachment and reducing the frequency in which it needs to be replaced.

FIG. 5 is a pictorial view of the attachment in a flexed condition.

It should be understood that the above described preferred alternate embodiments are simply illustrative of the principals of this invention and that numerous other embodiments may be readily devised without deviating therefrom. Therefore, only the following claims are intended to define this invention.

What is claimed is:

1. A disposable noise reducing hearing aid attachment for attaching to a hearing aid that has a housing with a sound inlet formed therein to transmit audible sound from the environment to an internal microphone, comprising:

a flexible pad;

said pad having an aperture formed therethrough for communicating with the sound inlet of the hearing aid to transmit audible sound from the environment to the hearing aid microphone;

a layer of flexible backing material operatively supporting said pad in which the backng material has a coating adhesive thereon for removably securing the attachment to the hearing aid housing;

a sound, moisture, and air filter associated with the pad aperture to (1) reduce the amplitude of audible noise transmitted from the environment to the hearing aid sound inlet; (2) prevent dust and other airborne particles from passing into the hearing aid sound inlet; and (3) absorb moisture; and said filter being constructed at least in part by moisture absorbent fibers selected from a group consisting of wool and cotton.

2. The hearing aid attachment as defined in claim 1 wherein the pad has a top surface for exposing to the environment with the pad aperture having an entrance opening formed therein;

said pad top surface having a surface region immediately adjacent the entrance opening that has a contrasting color to the remainder of the top surface to enable the user to more accurately place the attachment on the hearing aid housing with the pad aperture aligned with the hearing aid aubible sound inlet.

3. The hearing aid attachment as defined in claim 1 wherein the pad is constructed of a polyvinyl plastic foam material.

4. The hearing aid attachment as defined in claim 1 wherein the filter is superimposed within the pad aperture having a shape complementary with the pad aperture.

5. The hearing aid attachment as defined in claim 1 wherein the sound, moisture, and air filter is formed in an extended layer superimposed over the pad opening and sandwiched between the pad and the flexible backing.

6. The hearing aid attachment defined in claim 1 wherein the filter layer has a first region surrounding the pad opening and a second region spaced from the pad opening wherein the second filter region contains sodium chloride to draw moisture from the pad opening through the first filter region to the second filter region to remove moisture from the pad aperture and the sound inlet.

* * * * *